US010900306B2

(12) United States Patent
Trunk et al.

(10) Patent No.: US 10,900,306 B2
(45) Date of Patent: Jan. 26, 2021

(54) SYSTEMS AND METHODS FOR REDUCING BIT DAMAGE IN A LANDING TOOL

(71) Applicant: Schlumberger Technology Corporation, Sugar Land, TX (US)

(72) Inventors: Philip G. Trunk, Houston, TX (US); Tommy G. Ray, Spring, TX (US); Jeremy O'Neal, Spring, TX (US); Dwayne P. Terracina, Spring, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 332 days.

(21) Appl. No.: 15/814,935

(22) Filed: Nov. 16, 2017

(65) Prior Publication Data

US 2018/0155999 A1 Jun. 7, 2018

Related U.S. Application Data

(60) Provisional application No. 62/429,145, filed on Dec. 2, 2016.

(51) Int. Cl.

| | |
|---|---|
| ***E21B 23/02*** | (2006.01) |
| ***E21B 17/04*** | (2006.01) |
| ***E21B 10/26*** | (2006.01) |
| ***E21B 29/00*** | (2006.01) |

(52) U.S. Cl.

CPC ..... *E21B 23/02* (2013.01); *E21B 10/26* (2013.01); *E21B 17/04* (2013.01); *E21B 29/002* (2013.01)

(58) Field of Classification Search

CPC ..... E21B 43/10; E21B 23/02; E21B 23/06

See application file for complete search history.

(56) References Cited

U.S. PATENT DOCUMENTS

| | | | | | |
|---|---|---|---|---|---|
| 2,798,559 | A * | 7/1957 | Fredd | E21B 43/10 | 166/125 |
| 2,862,564 | A * | 12/1958 | Bostock | E21B 23/02 | 166/214 |
| 3,074,485 | A * | 1/1963 | McGowen, Jr. | E21B 23/03 | 166/217 |
| 3,208,531 | A * | 9/1965 | Tamplen | E21B 23/02 | 166/125 |
| 3,845,815 | A * | 11/1974 | Garwood | E21B 34/14 | 166/154 |
| 3,856,081 | A * | 12/1974 | Canalizo | E21B 23/02 | 166/123 |
| 4,007,783 | A * | 2/1977 | Amancharla | E21B 23/02 | 166/135 |
| 4,018,277 | A * | 4/1977 | Gazda | E21B 23/02 | 166/214 |
| 4,126,179 | A * | 11/1978 | Long | E21B 23/02 | 166/156 |
| 4,154,298 | A * | 5/1979 | Gano | E21B 23/06 | 166/243 |

(Continued)

*Primary Examiner* — Kipp C Wallace

(57) ABSTRACT

A landing tool includes a body with an inner surface. A receiving groove is located on the inner surface and includes a first groove portion and a second groove portion separated by a tab. At least a portion of the tab is recessed from the inner surface of the landing tool. At least a portion of the second groove portion may further be recessed from one or both of the inner surface of the landing tool or an inner surface of the tab.

15 Claims, 9 Drawing Sheets

(56) References Cited

U.S. PATENT DOCUMENTS

| | | | | |
|---|---|---|---|---|
| 4,378,931 | A * | 4/1983 | Adams, Jr. | E21B 34/106 251/58 |
| 4,468,055 | A * | 8/1984 | Reimert | E21B 33/043 285/123.4 |
| 4,529,035 | A * | 7/1985 | Bayh, III | E21B 43/12 166/106 |
| 4,545,434 | A * | 10/1985 | Higgins | E21B 23/02 166/217 |
| 5,020,591 | A * | 6/1991 | Shore | E21B 17/046 166/55 |
| 5,026,097 | A * | 6/1991 | Reimert | E21B 33/043 166/208 |
| 5,620,052 | A * | 4/1997 | Turner | E21B 33/043 166/208 |
| 6,029,744 | A * | 2/2000 | Baird | E21B 23/02 166/167 |
| 6,283,218 | B1 * | 9/2001 | Collins | E21B 23/02 166/115 |
| 7,640,984 | B2 | 1/2010 | Vert et al. | |
| 7,766,581 | B2 * | 8/2010 | Munk | E21B 33/038 405/224.2 |
| 7,909,109 | B2 | 3/2011 | Angman et al. | |
| 7,926,578 | B2 | 4/2011 | Moffitt et al. | |
| 7,926,590 | B2 | 4/2011 | Eriksen et al. | |
| 8,733,474 | B2 | 5/2014 | Nikiforuk | |
| 8,851,167 | B2 | 10/2014 | Eriksen | |
| 2008/0000696 | A1 * | 1/2008 | McGarian | E21B 21/103 175/256 |
| 2008/0230233 | A1 * | 9/2008 | Fay | E21B 23/01 166/382 |
| 2016/0245040 | A1 * | 8/2016 | Nelson | E21B 33/04 |

* cited by examiner

SYSTEMS AND METHODS FOR REDUCING BIT DAMAGE IN A LANDING TOOL

CROSS-REFERENCE TO RELATED APPLICATIONS

This application claims the benefit of, and priority to, U.S. Patent Application No. 62/429,145, filed Dec. 2, 2016 and titled "Systems and methods for Reducing Bit Damage in a Landing Tool," which application is incorporated herein by this reference in its entirety.

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to allow extraction of the fluids from the formations. Wellbores used to produce or extract fluids may be lined with casing around the walls of the wellbore. A variety of drilling methods may be utilized depending partly on the characteristics of the formation through which the wellbore is drilled.

Some wellbores are reinforced with casing after drilling to stabilize the wellbore and to isolate the interior of the wellbore from the surrounding formation. Casing may of a tubular shape and formed of steel or another metal that provides a durable surface for the interior of the wellbore. The casing allows downhole tools to be tripped into the wellbore with little or no damage to the integrity of the wellbore.

SUMMARY

In some embodiments, a landing tool includes a body having an inner surface defining an opening in the body. A receiving groove is located circumferentially on the inner surface, and a tab is located within the receiving groove. The tab has a tab height relative to the receiving groove and is recessed a tab recess distance relative to the inner surface of the body.

In other embodiments, a wellbore casing includes at least one casing segment and a landing tool coupled to the at least one casing segment. The landing tool includes a tubular body having an inner surface and an outer surface. A receiving groove is located within the inner surface of the tubular body and has a first groove portion and a second groove portion. A tab axially separates the first and second grooves. A trailing portion of the second groove portion has an axial length greater than a leading portion of the first groove portion.

In yet other embodiments, a method of moving a cutting tool in a landing tool includes tripping the cutting tool through the landing tool. The cutting tool contacts the inner surface of the landing tool, and during such contact and while the cutting elements are axially aligned with a tab of the landing tool, cutting elements on a gage or shoulder surface of the cutting tool are radially offset from a tab of the landing tool.

In yet other embodiments, a method of moving a cutting tool in a landing tool includes tripping the cutting tool through the landing tool. The cutting tool contacts the inner surface of a tab of the landing tool, and during such contact and while the cutting elements are axially aligned with an outer trailing surface of a second groove portion of the landing tool, cutting elements on a gage or shoulder surface of the cutting tool are radially offset from the outer trailing surface of the second groove portion of the landing tool.

This summary is provided to introduce a selection of concepts that are further described below in the detailed description. This summary is not intended to identify key or essential features of the claimed subject matter, nor is it intended to be used as an aid in limiting the scope of the claimed subject matter. Rather, additional features and aspects of embodiments of the disclosure will be set forth in the description that follows, and in part will be apparent from the description, or may be learned by the practice of such embodiments. The features and aspects of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof that are illustrated in the appended drawings. While some of the drawings may be schematic or exaggerated representations of concepts, drawings not indicated as being schematic or exaggerated should be considered to scale for some embodiments of the present disclosure. Understanding that the drawings depict some example embodiments, the embodiments will be described and explained with additional specificity and detail through the use of the accompanying drawings in which.

DETAILED DESCRIPTION

Embodiments of the present disclosure generally relate to devices, systems, and methods for securing and removing a downhole tool. More particularly, some embodiments of the present disclosure relate to devices, systems, and methods for engaging a casing wall or feature in a casing wall with a downhole tool. In some embodiments, the casing may include one or more features to allow for an increased operational lifetime, protection against damage to the casing during use, or protection against drilling or cutting tools passing through the casing.

In some embodiments, a casing according to the present disclosure may include a landing tool for coupling one or more downhole tools to the casing. For instance, the landing tool may be used to land or otherwise couple a plug to the landing tool and/or a casing string coupled to the landing tool. The landing tool may have a body with an inner surface and an outer surface. In some embodiments, the inner surface may define an opening through the body in which one or more downhole tools may be positioned.

In some embodiments, the inner surface of the body may include a groove oriented rotationally about a longitudinal axis of the body. In other embodiments, the groove may extend about the entire circumference of the body. In some embodiments, the groove may be a plug landing nipple.

Figure 1:
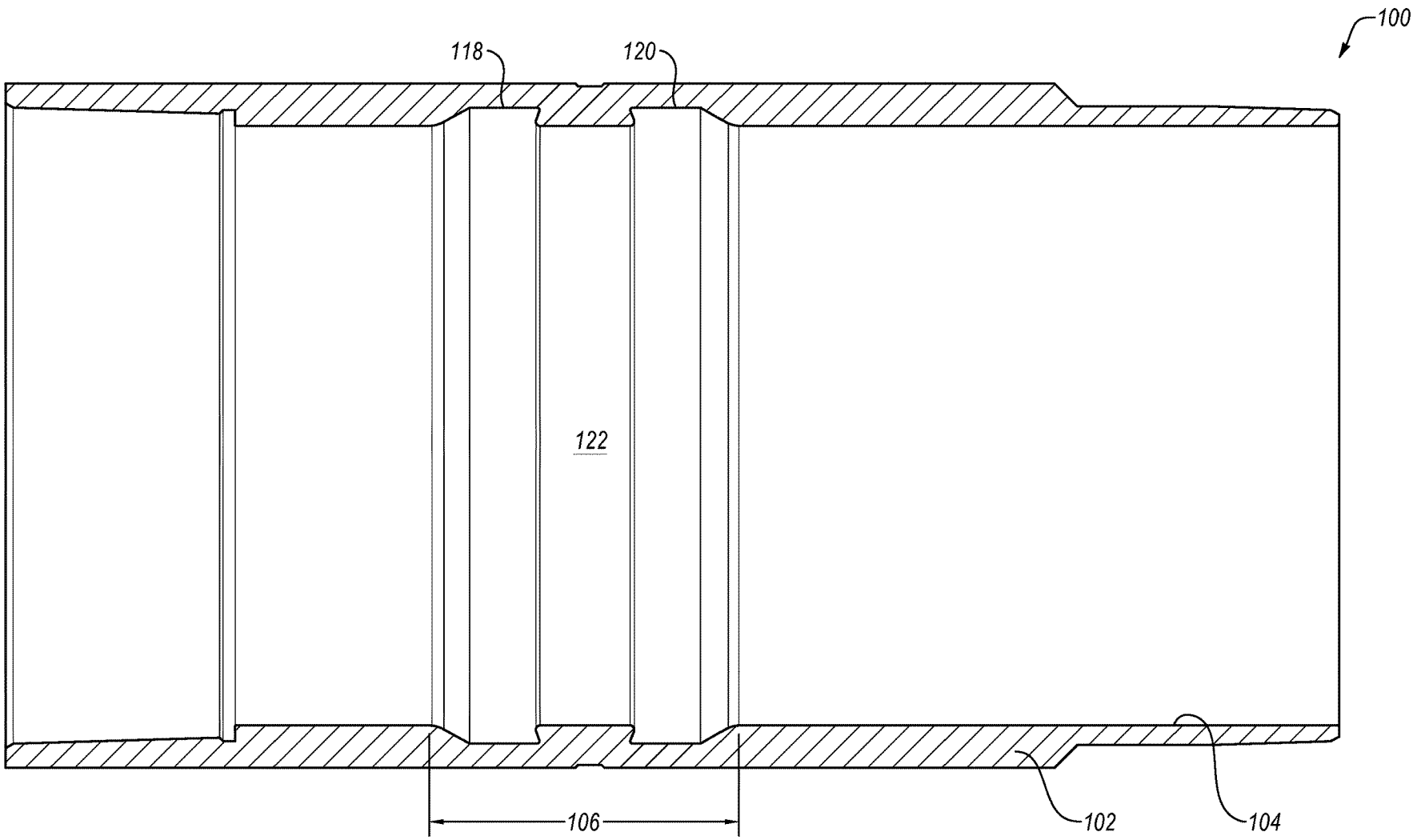
FIG. 1 is side cross-sectional view of a landing tool with a plug landing nipple (PLN), according to some embodiments of the present disclosure.

FIG. 1, for instance, illustrates an example casing or landing tool 100, that includes a body 102. The body 102 includes an inner surface 104 having one or more receiving grooves 106. The one or more receiving grooves 106 may define or be part of a plug landing nipple (PLN). A PLN may be formed in the inner surface 104 of the casing or landing tool 100 to allow various downhole tools, such as a downhole plug, to engage with the landing tool 100 and be axially and/or rotationally secured relative to the landing tool 100.

The groove 106 may include first portion 118 and a second portion 118 with a tab 122 between the first portion 118 and the second portion 118. During use in a downhole environment, one or more cutting tools, such as a drill bit, a mill, an underreamer, or other cutting device with cutting elements on may move axially past the groove 106. The cutting elements of the cutting tool may damage the landing tool 100 or features of the landing tool 100 that contact the cutting elements. In some cases, when the cutting elements engage the landing tool 100, the cutting elements may be damaged.

In some embodiments, the groove 106 may be modified according to embodiments of the present disclosure to include one or more recessed surfaces, one or more beveled surfaces, one or more asymmetric features, or combinations thereof to limit or prevent damage to portions of the groove or the tab between groove portions, to limit or prevent damage to the cutting elements of a cutting tool passing through the landing tool, or to limit or prevent damage to both the landing tool and the cutting tool.

Figure 2:
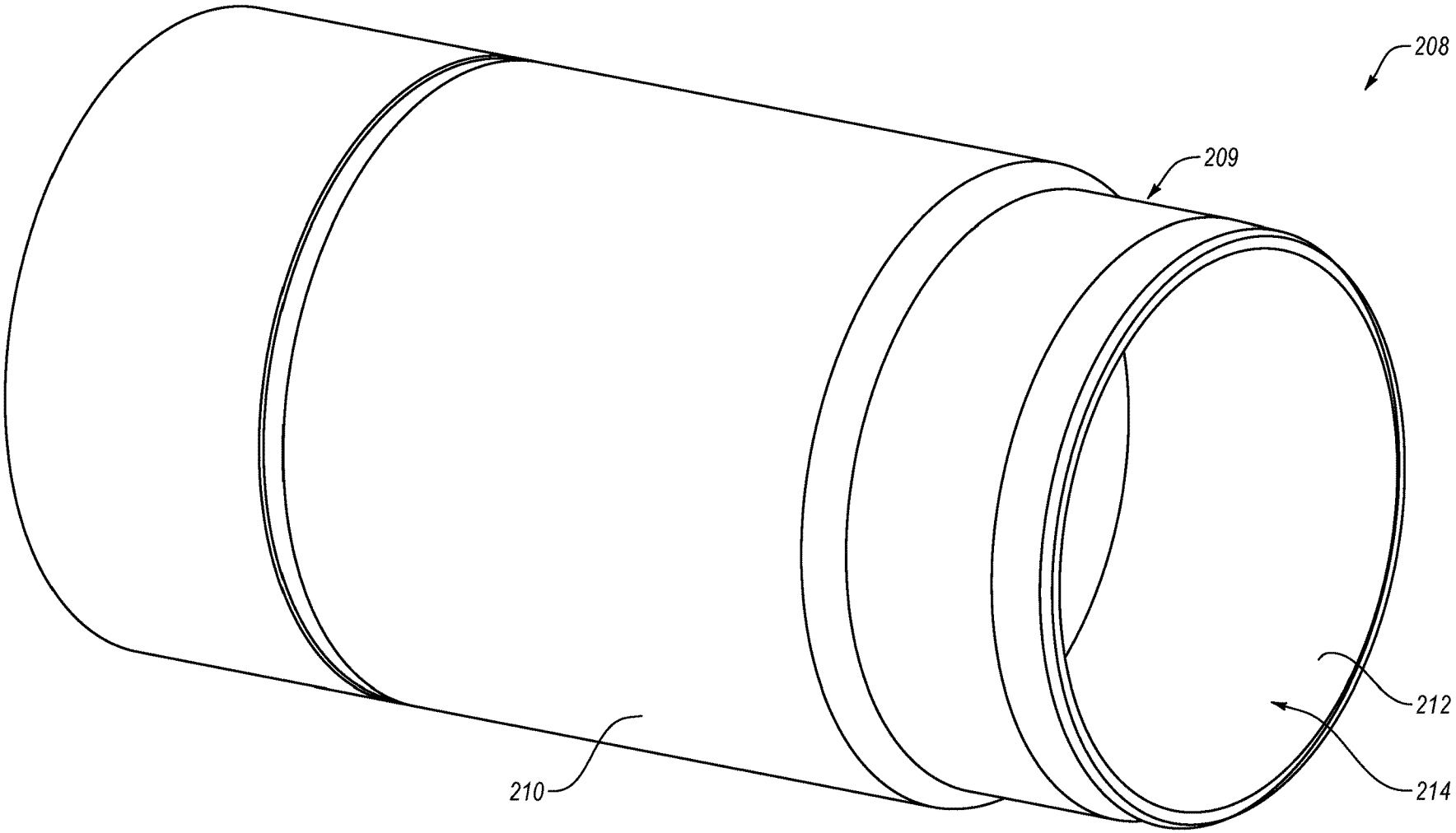
FIG. 2 is a perspective view of a landing tool, according to some embodiments of the present disclosure.

FIG. 2 is a perspective view of an embodiment of a landing tool 208, according to some embodiments of the present disclosure. The landing tool 208 may be part of a casing string, or coupled thereto, in some embodiments of the present disclosure. In other embodiments, however, the landing tool 208 may be part of other tools or systems. In at least some embodiments, the landing tool 208 may have a substantially tubular body 209 with an outer surface 210 and an inner surface 212. The inner surface 212 may define an opening 214 through at least a portion of the landing tool 208 (e.g., with an inner diameter equal to an inner diameter of a casing or liner string). In some embodiments, the outer surface 210 of the body 209 may have a cross-sectional shape that is at least partially circular, rectangular, octagonal, other regular polygonal, irregular, or combinations thereof. In at least some embodiments, the body 209 may have a cross-section that is circular or annular. For instance, the outer surface of the body 209 may define a circular cross-section having a diameter equal to an outer diameter of a casing or liner string.

The opening 214 may be sized or otherwise configured to receive a downhole tool therein. In some embodiments, the opening 214 may be sized to allow a downhole tool within the opening 214 to pass through and continue beyond the landing tool 208. When passing through the landing tool 208, drill pipe, other downhole tools, or other components of a drill string may be within the opening 214 and move along the axial length of the opening 214 as the downhole tool moves within the wellbore. In other embodiments, the opening 214 may be sized to allow at least a portion of a downhole tool to enter the landing tool 208 and engage with a landing structure on or coupled to the inner surface 212 of the landing tool 208.

Figure 3:
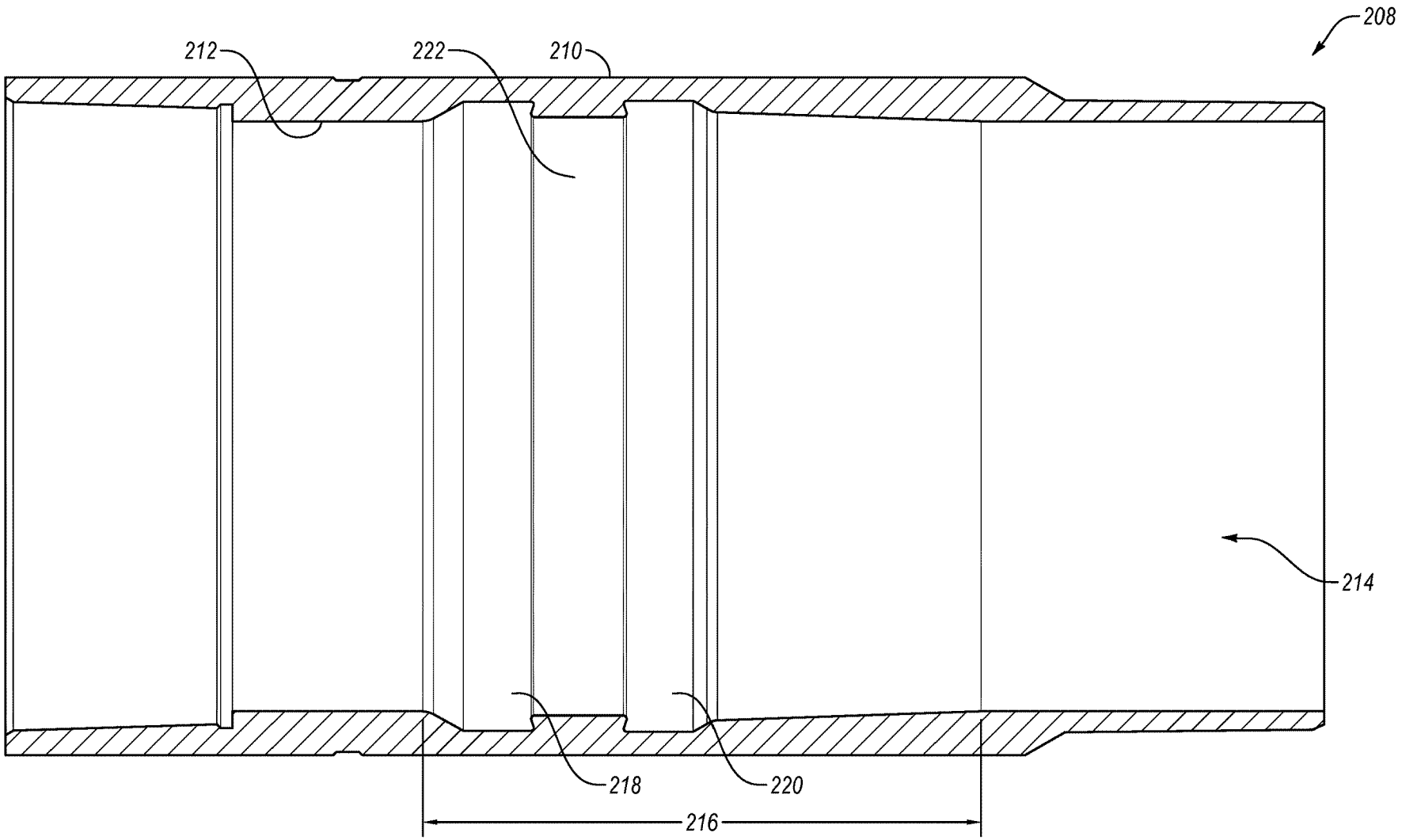
FIG. 3 is a side cross-sectional view of the landing tool of FIG. 2, according to some embodiments of the present disclosure.

FIG. 3 is a cross-sectional view of the landing tool 208 of FIG. 2. In some embodiments, the outer surface 210 of the landing tool 208 may have an outer diameter that is substantially constant along a full axial length of the landing tool 208. In other embodiments, the outer surface 210 may include one or more features to facilitate connection of the landing tool 208 to one or more other tools or components in a downhole environment. For instance, one or more axial ends of the landing tool 208 may include threaded box or pin connections to allow the landing tool 208 to be coupled to a segments of casing/liner in a casing string.

In some embodiments, the landing tool 208 may have a receiving groove 216 that is at least partially recessed into the landing tool 208 relative to the inner surface 212 (e.g., extending radially outward from the inner surface 212 and opening 214 and toward the outer surface 210). In some embodiments, the groove 216 may have at least a first portion 218 and a second portion 220 that are axially separated by a tab 222 axially between the first portion 218 and the second portion 220. In some embodiments, the groove 216 may be continuous about a circumference of the inner surface 212. In other embodiments, the groove 216 may have one or more breaks or gaps between portions of the groove in the rotational (i.e., circumferential) direction. For example, a segment of the groove 216 may extend in a rotational direction around a portion of the inner surface 212 less than 360°. In some embodiments, the groove 216 may include a plurality of segments with gaps therebetween. For instance, in a non-limiting example, there may be three groove segments each extending circumferentially over a 90° span, a 30° gap between each groove segment.

In some embodiments, an axial length of the first portion 218 and an axial length of the second portion 220 of the groove 216 may be equal. In other embodiments, the first portion 218 of the groove 216 may have a greater axial length than the second portion of the groove 220. In still other embodiments, the second portion 220 of the groove 216 may have a greater axial length than the first portion 218 of the groove 216 (see FIG. 3). In some embodiments, the second portion 220 may have an axial length that is greater than an axial length of the first portion 218 by a ratio of at least 2:1, at least 3:1, at least 4:1, at least 5:1, or more. For example, the embodiment of a second portion 220 in FIG. 3 is approximately four times longer in the axial direction than the first portion 218 (e.g., a 4:1 ratio).

Figure 4:
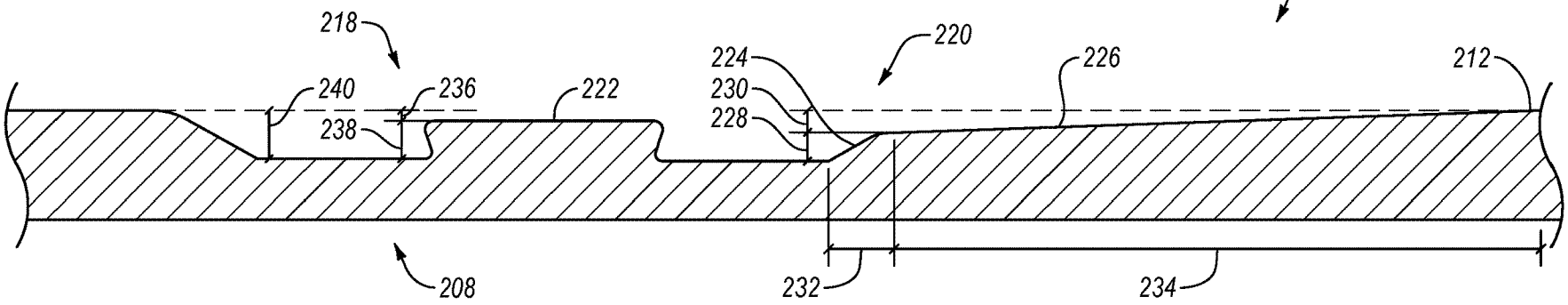
FIG. 4 is a side cross-sectional detail view of a receiving groove of the landing tool of FIG. 3, according to some embodiments of the present disclosure.

FIG. 4 is a side cross-sectional detail view of the groove 216 of FIG. 3. As described herein, the groove 216 may have a first portion 218 and a second portion 220 separated axially by a tab 222. In some embodiments, the tab 222 may have one or more undercut portions such that the tab 222 has a generally dovetail shape in cross-section. In some embodiments, the tab 222 may be symmetrical in the axial direction. In other embodiments, the tab 222 may have asymmetric undercut portions, or otherwise be asymmetric. In yet other embodiments, the tab 222 may have an undercut portion on a single axial side, resembling half a dovetail.

In some embodiments, the second portion 220 of the groove 216 may have a trailing portion including an outer trailing surface 224 and an inner trailing surface 226 (i.e., the inner trailing surface 226 may be closer to the inner surface 212 and radially inward relative to the outer trailing surface 224). The outer trailing surface 224 and inner trailing surface 226 may be axially adjacent, intersecting, or potentially contacting one another. In some embodiments, a junction of the outer trailing surface 224 and inner trailing surface 226 may be discontinuous (i.e., an angle or corner may be formed due to differences in angle between the outer and inner trailing surfaces 226, 224). In other embodiments, the junction of the outer trailing surface 224 and inner trailing surface 226 may be a continuous, radiused surface (e.g., a rounded corner). In at least some embodiments, the inner trailing surface 226 may be axially nearer the first portion 218 of the groove 216, the tab 222, or both.

The outer trailing surface 224 may have an outer trailing surface height 228, which may be the radial difference between the outermost point and the innermost point of the outer trailing surface 224. In FIG. 4, for instance, the innermost point of the outer trailing surface 224 is shown as being located adjacent the inner trailing surface 226, and the outermost point of the outer trailing surface 224 is shown as being nearer the tab 222, and optionally adjacent a generally planar portion of the second portion 220 of the groove 216. The inner trailing surface 226 may define an inner trailing surface height 230, which may be the radial difference between the outermost point and the innermost point of the outer trailing surface 224. In FIG. 4, for instance, the outermost point of the inner trailing surface 226 may be adjacent the outer trailing surface 224, and the innermost point of the inner trialing surface 226 may be adjacent the inner surface 212 of the landing tool 208. The outer trailing surface height 228 and the inner trailing surface height 230 may combine to form a radial height of the second portion 220 from the bottom of the second portion 220 of the groove 216 to the inner surface 212. In some embodiments, a trailing surface height ratio may be defined between the outer trailing surface height 228 and the inner trailing surface height 230, and may be in a range having an upper value, a lower value, or upper and lower values including any of 0.1, 0.25, 0.5, 0.75, 0.9, 1.0, 2.5, 5.0, 7.5, 9.0, 10.0, or any values therebetween. For example, the trailing surface height ratio may be greater than 0.1. In other examples, the trailing surface height ratio may be less than 10.0. In yet other examples, the trailing surface height ratio may be in a range of 0.1 to 10.0. In at least one example, the trailing surface height ratio may be about 1.0 or about 1.35. In other embodiments, the trailing surface height ratio may be less than 0.1 or greater than 10.0.

In some embodiments, the groove 216 may taper in the direction of the second portion 220. For example, the trailing portion of the second portion 220 may have a total axial length that is greater than an axial length of the leading portion of the first portion 218 of the groove 216. The greater total axial length of the trailing portion (outer trailing surface 224 and inner trailing surface 226) of the second portion 220, relative to the axial length of the leading portion (e.g., leading surface 225 of FIG. 5), may render the groove 216 asymmetrical about the tab 222. In some embodiments, the tapering of the groove 216 in the direction of the second portion 220 may include one or more trailing surfaces of the second portion 220 of the groove 216 that have a lower angle relative to the inner surface 212 than one or more leading surfaces of the first portion 218 of the groove 216.

The outer trailing surface 224 may have an axial outer trailing surface length 232, and the inner trailing surface 226 may have an axial inner trailing surface length 234. When combined, the outer and inner trailing surface lengths 232, 234 may define an axial trailing portion length of the second portion 220, which trailing portion length may extend axially from the portion of the outer trailing surface 224 at the bottom of the second portion 220 of the groove 216 (i.e., the radially outermost portion) to the portion of the inner trailing surface adjacent the inner surface 212. In some embodiments, a trailing surface length ratio may be defined by the inner trailing surface length 234 relative to the outer trailing surface length 232. In some embodiments, the trailing surface length ratio may be within a range having an upper value, a lower value, or upper and lower values including any of 0.025, 0.05, 0.1, 0.25, 0.5, 0.75, 0.9, 1.0, 2.5, 5.0, 7.5, 10.0, 15.0, 20.0, or any values therebetween. For example, the trailing surface length ratio may be greater than 0.025. In other examples, the trailing surface length ratio may be less than 20.0. In yet other examples, the trailing surface length ratio may be in a range of 0.025 to 20.0. In at least one example, the trailing surface length ratio may be about 2.0 or 5.0. In other embodiments, the trailing surface length ratio may be less than 0.025 or greater than 20.0.

In some embodiments, the tab 222 may have a tab height 238 above the base of the groove 216. The tab height 238 may be equal to a depth of the groove 216, shown in FIG. 4 as the groove height 240. In other embodiments, however, the tab height 238 may be greater than or less than groove height 240. For instance, the top of the tab 222 (i.e., the radially innermost portion of the tab 222) may be radially offset from, and outward of, the inner surface 212 by a tab recess distance 236. In such an embodiment, the tab height 238 and the tab recess distance 236 may combine to be approximately equivalent to the groove height 240 from the base of the groove 216 to the inner surface 212. In some embodiments, the tab height 238 may be a portion of the groove height 240 and a tab height ratio may be defined by the tab height 238 relative to the groove height 240. The tab height ratio may be in a range having an upper value, a lower value, or upper and lower values including any of 0.1, 0.25, 0.5, 0.75, 0.8, 0.9, 0.95, 0.99, 1.0, 1.25, or any values therebetween. For example, the tab height ratio may be greater than 0.1. In other examples, the tab height ratio may be less than 0.9, 0.95, 0.99, or 1.25. In yet other examples, the tab height ratio may be in a range of 0.1 to 0.99 or in the range of 0.1 to 1.25. In at least one example, the tab height ratio may be about 0.8. In still other examples, the tab height ratio may be less than 0.1 or greater than 1.25

In some embodiments, the tab recess distance 236 may be at least partially related to the groove height 240. A tab recess ratio may be defined by the tab recess distance 236 relative to the groove height 240, and may be in a range having an upper value, a lower value, or upper and lower values including any of 0.01, 0.05, 0.1, 0.25, 0.5, 0.75, 0.9, or any values therebetween. For example, the tab recess ratio may be greater than 0.01. In other examples, the tab recess ratio may be less than 0.9. In yet other examples, the tab recess ratio may be in a range of 0.01 to 0.9. In at least one example, the tab recess ratio may be about 0.2. In other examples, the tab recess ratio may be less than 0.01 or greater than 0.9.

In at least some embodiments, an outer trailing surface height ratio may be defined by the outer trailing surface height 228 relative to the radial height of the second portion 220 of the groove 216. Optionally, the radial height of the second portion 220 may be equal to the groove height 240. In at least some embodiments, the outer trailing surface height ratio may be in a range having an upper value, a lower value, or upper and lower values including any of 0.1, 0.25, 0.5, 0.75, 0.9, 0.95, or 0.99. For example, the outer trailing surface height ratio may be greater than 0.1. In other examples, the outer trailing surface height ratio may be less than 0.99. In yet other examples, the outer trailing surface height ratio may be between 0.01 and 0.99. In at least one example, the outer trailing surface height ratio may be about 0.6. In other examples, the outer trialing surface height ratio may be less than 0.1 or greater than 0.99.

While the tab height 238 is shown in FIG. 4 as being measured relative to the depth of the first portion 218 of the groove 216, it should be appreciated that the tab height 238 may be measured with respect to the depth of the second portion 220 of the groove 216, and that such measurements may be equal. In other embodiments, however, the depth of the groove 216 may differ in the first and second portions 218, 220, in which case the tab 222 may have first and second tab heights 238. Further, while the height of the tab 222 is shown as being generally constant, the tab 222 may be tapered or have an otherwise contoured surface. For instance, a portion of the tab 222 adjacent the first portion 218 of the groove 216 may be at a different radial position than a portion of the tab 222 adjacent the second portion 220 of the groove 216. In such an embodiment, first and second tab recess ratios may be defined for the respective portions of the tab 222. The first and second tab recess ratios may differ, but may fall within the ranges for a tab recess ratio as described herein.

Figure 5:
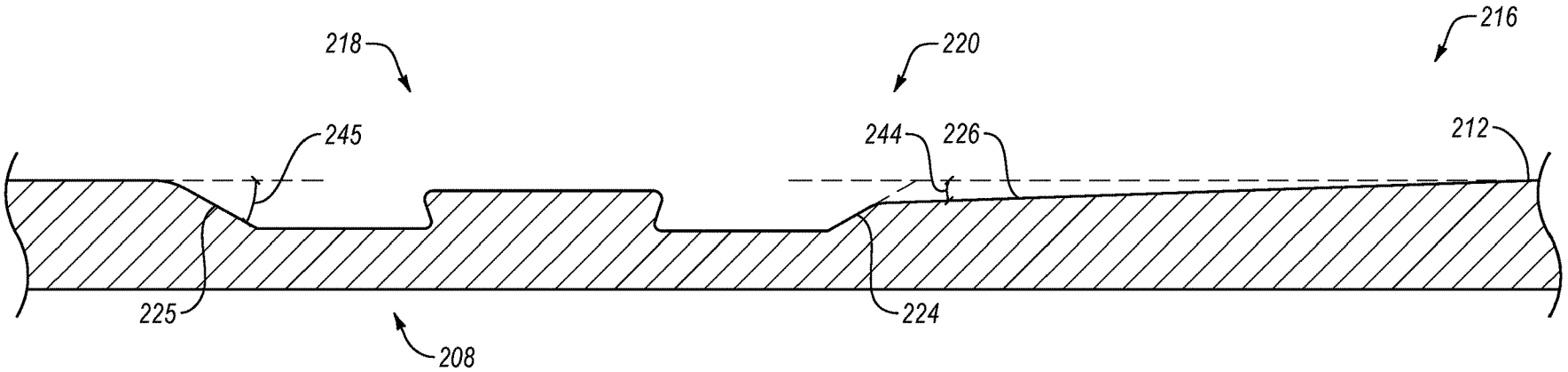
FIG. 5 is another side cross-sectional detail view of the receiving groove of the landing tool of FIG. 3, according to some embodiments of the present disclosure.

FIG. 5 illustrates the embodiment of a groove 216 of FIGS. 2 and 3. In some embodiments, at least a portion of the outer trailing surface 224 and at least a portion of the inner trailing surface 226 may be oriented at different angles relative to the inner surface 212. In some embodiments, an outer trailing surface angle 242 between at least a portion of the outer trailing surface 224 (and optionally a full length of the outer trailing portion 224) and the inner surface 212 may be in a range having an upper value, a lower value, or upper and lower values including any of 10°, 15°, 20°, 22°, 24°, 26°, 28°, 30°, 32°, 34°, 36°, 38°, 40°, 45°, 50°, 60° or any values therebetween. For example, the outer trailing surface angle 242 may be greater than 10° or greater than 20°. In other examples, the outer trailing surface angle 242 may be less than 40° or less than 60°. In yet other examples, the outer trailing surface angle 242 may be in a range of 10° to 60° or 20° to 40°. In at least one example, the outer trailing surface angle 242 may be about 25°. In still other embodiments, the outer trailing surface angle 242 may be less than 10° or greater than 60°.

In some embodiments, an inner trailing surface angle 244 may be defined between at least a portion of the inner trailing surface 226 (and potentially a full length of the inner trailing surface 226). The inner trailing surface angle 244 is, in some embodiments, in a range having an upper value, a lower value, or upper and lower values including any of 2°, 4°, 6°, 8°, 10°, 12°, 14°, 15°, 20°, or any values therebetween. For example, the inner trailing surface angle 244 may be greater than 2°. In other examples, the inner trailing surface angle 244 may be less than 15° or less than 20°. In yet other examples, the inner trailing surface angle 244 may be in a range of 2° to 15° or 2° to 20°. In at least one example, the inner trailing surface angle 244 may be about 5°. In still other embodiments, the inner trailing surface angle 244 may be less than 2° or greater than 20°.

In some embodiments, a leading angle 245 may be defined between at least a portion of a leading surface 225 (and potentially a full length of the leading surface 225) of the first portion 218 of the groove 216. The leading angle 245 is, in some embodiments, in a range having an upper value, a lower value, or upper and lower values including any of 10°, 15°, 20°, 22°, 24°, 26°, 28°, 30°, 32°, 34°, 36°, 38°, 40°, 45°, 50°, 60° or any values therebetween. For example, the leading angle 245 may be greater than 10° or greater than 20°. In other examples, the leading angle 245 may be less than 40° or less than 60°. In yet other examples, the leading angle 245 may be in a range of 10° to 60° or 20° to 40°. In at least one example, the leading angle 245 may be about 25°. In still other embodiments, the leading angle 245 may be less than 10° or greater than 60°. In some embodiments, the leading angle 245 may be about equal to the outer trailing surface angle 242. For instance, the leading angle 245 may be within 2° or within 5° of the outer trailing surface angle 242.

Figure 6:
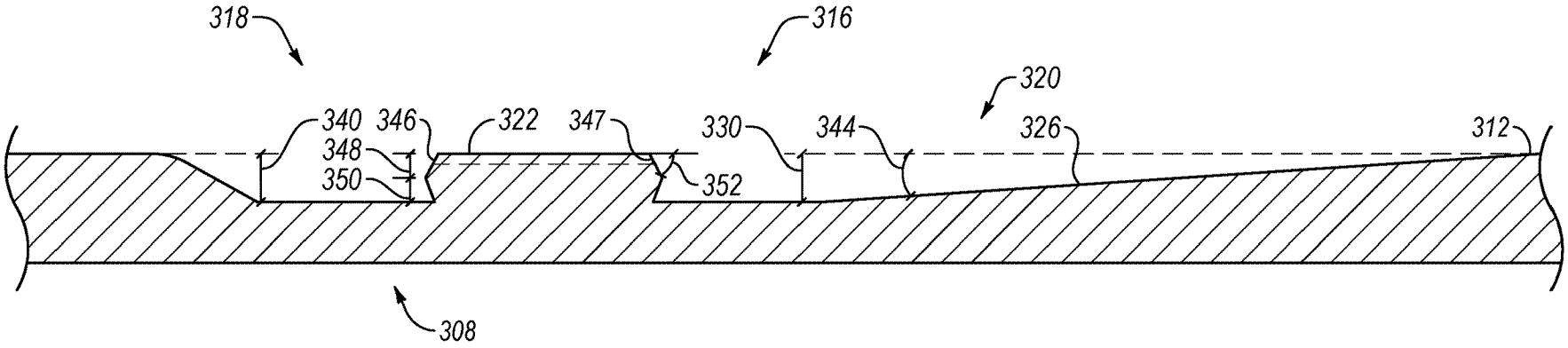
FIG. 6 is a side cross-sectional detail view of a receiving groove, according to additional embodiments of the present disclosure.

FIG. 6 is a side cross-sectional detail view of another embodiment of a receiving groove 316, according to some embodiments of the present disclosure. In some embodiments, a groove 316 may have a tab 322 with a tab leading edge and/or a tab trailing edge that is recessed from the top of the tab 322. For example, the tab 322 includes a tab leading surface 346 proximate the first portion 318 of the groove 316 and terminating at a tab leading edge, and optionally includes a trailing surface 347 on the opposing side of the tab 322 proximate the second portion 320 of the groove 316, which begins at the at a tab trailing edge. In some embodiments, the tab leading surface 346 (and/or trailing surface 347) may extend radially outward (and optionally axially away from an axial center of the tab 322), to define a tab leading surface height 348 and a remaining tab base height 350. In some embodiments, the tab leading surface height 348 and tab base height 350 may combine to be approximately equal to a groove height 340. In other embodiments, the tab leading surface height 348 and tab base height 350 may combine to be approximately equal to a tab height that is less than the groove height 340 (such as shown by the dashed line on the tab 322 and as described in relation to FIG. 4).

In some embodiments, a tab leading surface height ratio tab (e.g., a tab leading surface height 348 to the tab base height 350) may be in a range having an upper value, a lower value, or upper and lower values including any of 0.1, 0.25, 0.5, 0.75, 1.0, 2.5, 5.0, 7.5, 9.0, 10.0, or any values therebetween. For example, the tab leading surface height ratio may be greater than 0.1. In other examples, the tab leading surface height ratio may be less than 10.0. In yet other examples, the tab leading surface height ratio may be in a range of 0.1 to 10.0. In at least one example, the tab leading surface height ratio may be about 0.5 or about 1.0. In some embodiments, the tab leading surface height ratio may be less than 0.1 or greater than 10.0.

In some embodiments, a tab trailing surface 347 may have a tab trailing surface height ratio equivalent to the tab leading surface height ratio, although in other embodiments the tab trailing surface height ratio may be less than or greater than the tab leading surface height ratio. In at least some embodiments, the tab trailing surface height ratio may be in a range having an upper value, a lower value, or upper and lower values including any of 0.1, 0.25, 0.5, 0.75, 1.0, 2.5, 5.0, 7.5, 9.0, 10.0, or any values therebetween, or any values therebetween. For example, the tab trailing surface height ratio may be greater than 0.1. In other examples, the tab trailing surface height ratio may be less than 10.0. In yet other examples, the tab trailing surface height ratio may be in a range of 0.1 to 10.0. In at least one example, the tab trailing surface height ratio may be about 0.5 or about 1.0. In some embodiments, the tab trailing surface height ratio may be less than 0.1 or greater than 10.0.

The tab leading surface 346 and/or the tab trailing surface 347 may be oriented at an angle relative to the inner surface 312 to limit and/or prevent damage to the tab 322 during use. In some embodiments, a tab 322 may have a non-zero tab trailing surface angle 352 (which may be equal to or greater than the tab leading surface angle) relative to the inner surface 312. In some embodiments, the tab trailing surface angle 352 and/or tab leading surface angle may be in a range having an upper value, a lower value, or upper and lower values including any of 1°, 2°, 4°, 6°, 8°, 10°, 12°, 14°, 15°, 20°, 30°, 45°, 60°, or any values therebetween. For example, the tab trailing surface angle 352 and/or tab leading surface angle may be greater than 1°. In other examples, the tab trailing surface angle 352 and/or tab leading surface angle may be less than 60°. In yet other examples, the tab trailing surface angle 352 and/or tab leading surface angle may be in a range of 1° to 60°, 2° to 45°, or 5° to 15°. In at least one example, the tab trailing surface angle 352 and/or tab leading surface angle may be about 5°, about 15°, about 30°, or about 45°. In some embodiments, the tab trailing surface angle 352 and/or the tab leading surface angle may be less than 1° or greater than 60°. Further, while the tab leading surface 346 is shown as being linear or planar in the illustrated cross-sectional view, in other embodiments the tab leading surface 346 may have other contours or shapes. For instance, the tab leading surface 346 may be a chamfer, bevel, fillet, scallop, rounded, reverse-rounded, flat, or other type of feature or surface.

In some embodiments, the trailing portion of the second portion 320 of the groove 316 may have a single surface, as shown in FIG. 6. For example, the trailing portion may have an inner trailing surface 326 that is substantially continuous from the base of the second portion 320 of the groove 316 to the inner surface 312 of the landing tool 308. In some embodiments, the inner trailing surface 326 may have an inner trailing surface height 330 that is substantially equivalent to the groove height 340 of the second portion 320 of the groove 316.

In some embodiments, the inner trailing surface 326 may have an inner trailing surface angle 344 relative to the inner surface 312 in a range having an upper value, a lower value, or upper and lower values including any of 2°, 4°, 6°, 8°, 10°, 12°, 14°, 15°, 18°, 20°, 25°, 30°, or any values therebetween. For example, the inner trailing surface angle 344 may be greater than 2°. In other examples, the inner trailing surface angle 344 may be less than 30°. In yet other examples, the inner trailing surface angle 344 may be in a range of 2° to 30°. In at least one example, the inner trailing surface angle 344 may be about 5°. In some embodiments, the inner trailing surface angle 344 may be less than 2° or greater than 30°.

Figure 7:
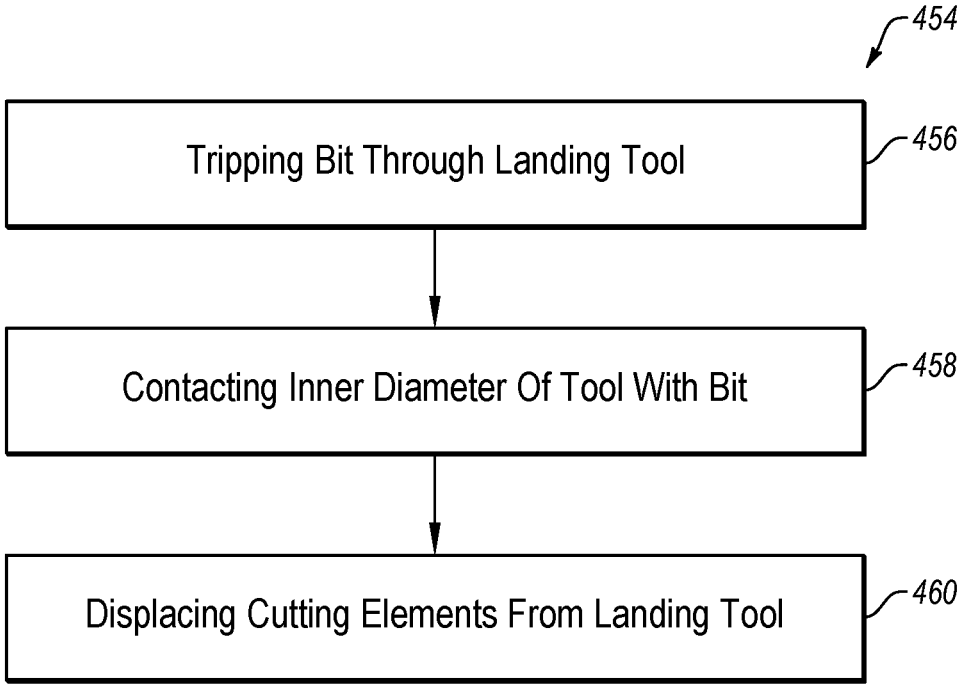
FIG. 7 is a flowchart of a method of moving a downhole tool through a landing tool, according to some embodiments of the present disclosure.
Figure 8:
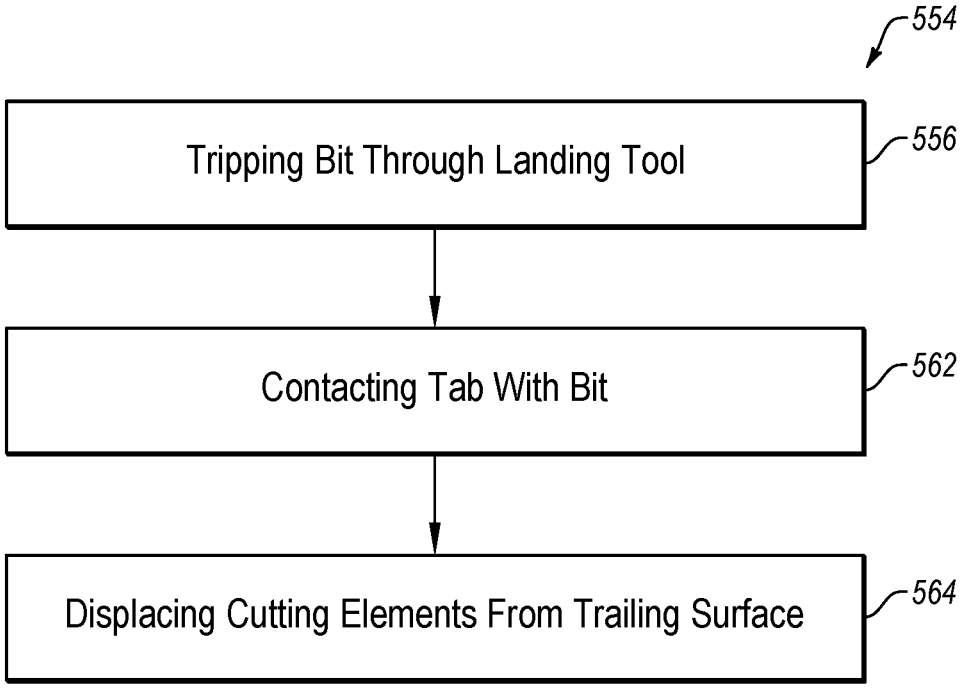
FIG. 8 is a flowchart of another method of moving a downhole tool through a landing tool, according to some embodiments of the present disclosure.
Figure 9:
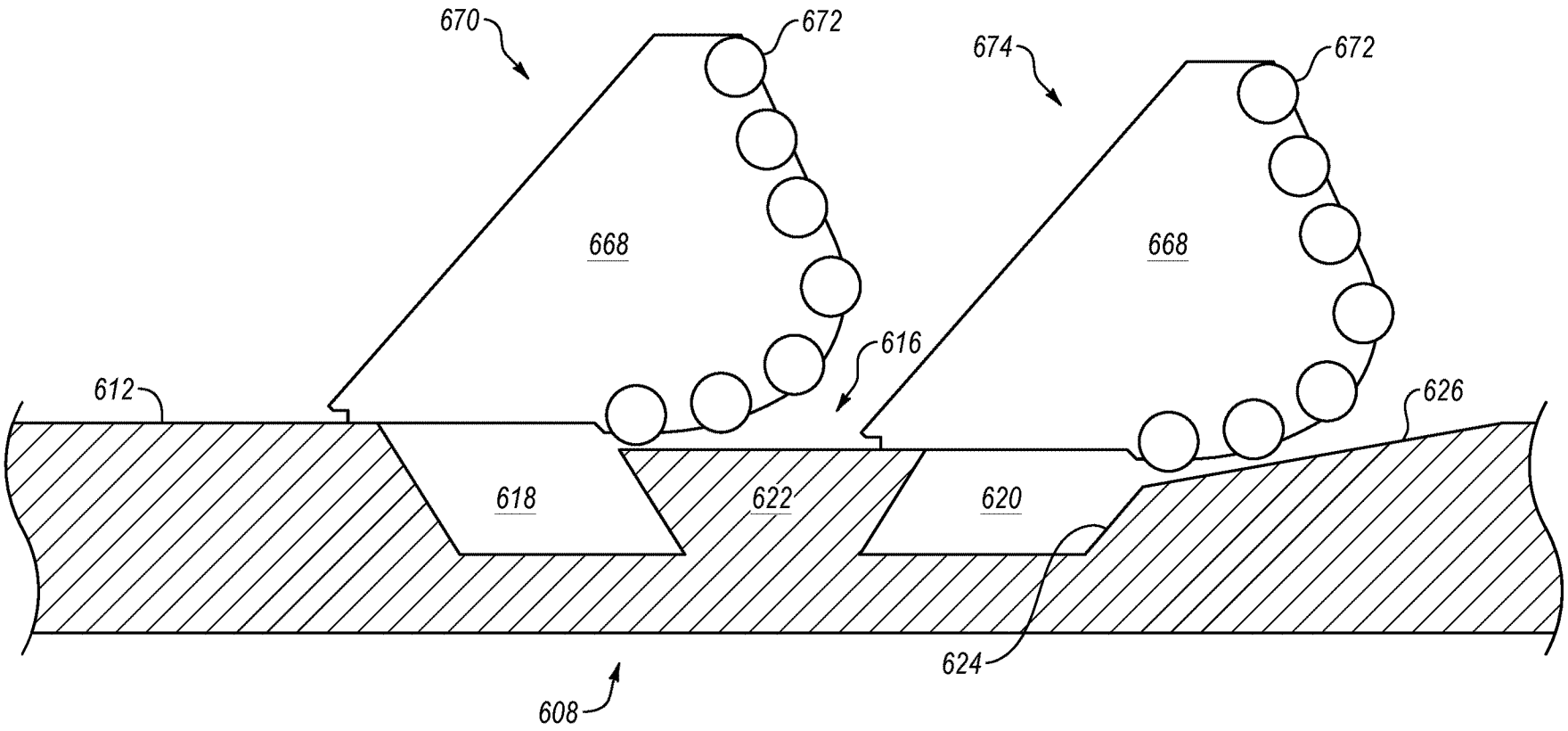
FIG. 9 is a side cross-sectional detail view of a receiving groove of a landing tool, with a bit moving along the landing tool, according to some embodiments of the present disclosure.

FIG. 7 through FIG. 9 illustrate embodiments of methods of moving a bit or other cutting tool through a landing tool or other device including a receiving groove according to embodiments of the present disclosure. For instance, a landing tool may be used to land a plug, and a bit or other cutting tool may then cut through the plug and continue drilling a wellbore or performing some other cutting, remedial, or other operation in a wellbore or other environment. In a particular example, the landing tool may catch a plug used during a casing-while-drilling (including liner-while-drilling) operation. The particular landing tools described herein may include a groove that enables the landing tool and corresponding casing/liner to provide full bore access, without a landing shoulder extending radially inward relative to the inner surface of the landing tool or casing/liner. Such a feature may be used to, for instance, convey and land a displacement plug that displaces cement used in a casing or liner cementing operation associated with a casing/liner-while-drilling operation.

FIG. 7 illustrates a method 454 that includes tripping a bit through at least a portion of a landing tool at 456. In at least some embodiments, the landing tool may include a receiving groove as described herein. For instance, the receiving groove may have a leading or first portion and a trailing or second portion. In at least some embodiments, a tab may be positioned between the leading and trailing portions, and the groove is optionally asymmetric about the tab. In some embodiments, tripping the bit through the landing tool at 456 may include cutting a plug or other element captured within the receiving groove.

As the bit trips through the landing tool at 456, the bit may contact the inner diameter (e.g., the inner surface 212 as shown in FIG. 2) of the landing tool at 458. For instance, a gage and/or shoulder surface of the bit (or of blades on the bit) may contact the inner diameter of the landing tool. The gage or shoulder surfaces of the bit may have one or more cutting elements thereon for cutting a wellbore wall, reaming, milling (e.g., milling a plug latched into the receiving groove), for otherwise removing material, or for any combination of the foregoing. In some embodiments, the cutting elements of the gage or shoulder surfaces may be damaged by the casing. The method 454 may, therefore, include reducing contact between the cutting elements and the landing tool. For instance, at 460, the cutting elements may be displaced from the landing tool. Displacing the cutting elements at 460 may include, for instance, maintaining cutting elements out of contact with a tab of the receiving groove when the cutting elements are axially aligned with the tab. By way of example, the inner surface of the casing or landing tool may at least partially support the bit or other cutting tool and the cutting elements on the gage or shoulder surface may be radially spaced from the tab. In at least some embodiments, a tab that is wholly or partially recessed relative to an inner diameter of the landing tool, as described in connection with some embodiments of the present disclosure, may provide sufficient displacement and clearance between the cutting elements and the tab to allow the cutting elements of the cutting tool to move axially through the landing tool or casing with minimal contact to the between the cutting elements and the landing tool or casing, thereby minimizing damage that the receiving groove and tab cause to the cutting elements.

FIG. 8 illustrates another method 554 of moving a bit or other cutting tool through a landing tool. The method may include tripping a bit or other cutting tool through at least a portion of a landing tool at 556. The landing tool may include a receiving groove as described herein. For instance, the receiving groove may have a tab or other surface that is recessed relative to an inner diameter of the landing tool, or may have a leading/trailing surface of such tab or other component that is recessed relative to the inner diameter of the landing tool. When tripping the bit through the landing too, the method includes contacting the tab (e.g., the tab 222 as shown in FIG. 2) of the landing tool with the bit at 562. For instance, a gage surface of the bit may contact the tab or other component. In at least some embodiments, when the gage surface of the bit is in contact with the tab, cutting elements on a gage, shoulder, or other portion of the cutting tool may be axially aligned with a trailing surface of the receiving groove. In some embodiments, contact between the trailing surface and the cutting elements may be minimized. For instance, the method 554 may further include displacing the cutting elements from the trailing surface at 564. Displacing the cutting elements may include maintaining the cutting elements elevated from and out of contact with the trailing surface, thereby limiting or even preventing damage that the casing or landing tool may cause to the cutting elements. Such displacement may be facilitated at least in part due to a portion of the trailing surface (e.g., a junction between an inner trailing surface and either the bottom of the second portion of the groove or an outer trailing surface) being recessed relative to the tab. Ultimately, continued axial movement of the bit or other cutting tool may cause the cutting elements to contact the trailing surface (e.g., an outer trailing surface), but a taper on the outer trailing surface may reduce sharp edges engaging and causing impact damage to the cutting elements.

In some embodiments, displacing the cutting elements from the trailing surface may include displacing the cutting elements from an outer trailing surface and allowing the cutting elements (or other portion of the bit) to contact the tab and/or an inner trailing surface. For example, the inner trailing surface may be at a lower surface angle relative to the inner surface of the casing, and may cause less damage to the cutting elements.

In yet other embodiments, use of a cutting tool and/or landing tool or other device may be understood with reference to FIG. 9. For clarity, the description of FIG. 9 will include references to FIGS. 7 and 8, as the methods of FIGS. 7 and 8 may also be wholly or partially incorporated into use of the system of FIG. 9.

In some embodiments, a bit, reamer, mill, or other cutting tool (collectively bit 668) may be conveyed, extended, or otherwise tripped through a landing tool 608, as shown in FIG. 9 (see 456 and 556 of FIGS. 7 and 8). In a first position, the bit 668 may be moved to a first position 670. In the first position 670, a gage or shoulder portion of the bit 668 is supported by or otherwise engages an inner surface 612 of the landing tool 608 (see 458 of FIG. 7). The bit 668 may include cutting elements 672 located axially downhole of the point of contact between the bit 668 and the inner surface 612. The cutting elements 672 may be located on one or more blades, cutter blocks, cutting faces, or other features of the bit 668. In at least some embodiments, the landing tool 608 may include a groove 616, and at least some of the cutting elements 672 may be axially aligned with a tab 622 of the groove 616 while the bit 668 is in contact with the inner surface 612 (e.g., at a point that is uphole of a first groove portion 618).

The tab 622 may be recessed relative to the inner surface 612 (e.g., tab 222 of FIG. 4) or may have at least a leading surface that is recessed relative to the inner surface 612 (e.g., tab 322 of FIG. 6). In such embodiments, and as shown in FIG. 9, when the bit 668 is in the first position 670, a fully or partially recessed tab 622 may cause the cutting elements 672 of the bit 668 to be radially offset or otherwise displaced from a full or partial portion of the tab 622 (see 460 of FIG. 7). The bit 668 may thus be supported within the landing tool 608 as a result of contact with the inner surface 612, but the cutting elements 672 may have reduced or potentially no contact with the tab 622, thereby reducing any damage to the cutting elements 672 that may be caused by contact with sharp edges or other features of the tab 622. In at least some embodiments, the offset between the cutting elements 672 and the tab 622 may be about equal to, or greater than, the tab recess distance or tab leading surface height.

As the bit 668 is further conveyed through the landing tool 608, the point of contact between the bit 668 and the landing tool 608 may move axially toward a trailing edge of a second groove portion 620 of the groove 616. When the gage or shoulder of the bit 668 is axially aligned with the tab 622, the bit 668 may contact the tab 622 (see 562 of FIG. 8), as illustrated by the second position 674 of the bit in FIG. 9. In at least some embodiments, at least some of the cutting elements 672 of the bit 668 may be axially aligned with a trailing surface of the groove 616 while the bit 668 is in contact with the tab 622.

At least a portion of the trailing surface may be recessed relative to the tab 622. For instance, the trailing surface may include an outer trailing surface 624 that joins with an inner trailing surface 622 at a continuous or discontinuous junction. In another embodiment, the trailing surface may include a single surface (e.g., inner trailing surface 344 of FIG. 6). The outer trailing surface 624 may be recessed relative to the tab 622, and optionally a full or partial portion of the inner trailing surface 626 may be recessed relative to the tab 622. In such embodiments, and as shown in FIG. 9, when the bit 668 is in the second position 674, the recessed trailing surface(s) 624, 626 may cause the cutting elements 672 of the bit 668 to be radially offset or otherwise displaced from a full or partial portion of the trailing surface(s) 624, 626 (see 564 of FIG. 8). The bit 668 may thus be supported within the landing tool 608 as a result of contact with the tab 622, but the cutting elements 672 may have reduced or potentially no contact with the trailing surface(s) 624, 626, thereby reducing any damage to the cutting elements 672 that may be caused by contact with sharp edges or other features of the trailing surface(s) 624, 626. In at least some embodiments, the offset between the cutting elements 672 and the trailing surface 624, 626 may be about equal to, or potentially less than or greater than, the inner trailing surface height.

Casings or other landing tools including a receiving groove according to embodiments of the present disclosure may cause less damage to cutting tools during use, extending the operational lifetime of the cutting tools, and allowing the cutting tools to more efficiently mill plugs or other components coupled to the casing or landing tools, drill into formation to extend a wellbore, or perform other cutting, milling, or reaming operations.

While embodiments of landing tools have been primarily described with reference to wellbore drilling operations, the landing tools described herein may be used in applications other than the drilling of a wellbore. In other embodiments, for instance, landing tools according to the present disclosure may be used outside a wellbore or other downhole environment used for the exploration or production of natural resources. For instance, landing tools of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not each feature of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," "generally," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole landing tool, comprising:

a body having a body inner surface defining an opening in the body;

a receiving groove located circumferentially on the body inner surface, the receiving groove including a first groove portion and a second groove portion, the first groove portion including a leading surface at an uphole end of the receiving groove, the leading surface extending from a first groove inner surface to the body inner surface, a leading angle being defined between a full length of the leading surface and the body inner surface being between 10° and 60°, the second groove portion including a trailing surface at a downhole end of the receiving groove comprising an outer trailing surface extending at a first angle having an outer trailing surface height less than a tab height of a tab, the trailing surface further including an inner trailing extending axially at a second angle and between the outer trailing surface and the body inner surface; and the tab located within the receiving groove and axially separating the first groove portion and the second groove portion, the tab defining an inner diameter which is greater than an inner diameter defined by the body inner surface directly uphole and downhole of the receiving groove.

2. The downhole landing tool of claim 1, the receiving groove having a groove height and the inner trailing surface having an inner trailing surface height, a total of the inner trailing surface height and the outer trailing surface height being about equal to the groove height.

3. The downhole landing tool of claim 1, an angle between the outer trailing surface of the second groove portion and the body inner surface being greater than an angle between the inner trailing surface of the second groove portion and the body inner surface.

4. The downhole landing tool of claim 1, at least a portion of the inner trailing surface being at a 2° to 15° angle relative to the body inner surface.

5. The downhole landing tool of claim 1, at least a portion of the outer trailing surface being at a 20° to 40° angle relative to the body inner surface.

6. The landing tool of claim 1, the leading angle being between 20° and 40°.

7. A wellbore casing, comprising:

at least one casing segment; and a downhole landing tool coupled to the at least one casing segment, the downhole landing tool including:

a tubular body having a body inner surface and an outer surface extending between a leading end and a downhole end;

a receiving groove located within the body inner surface, the receiving groove having a first groove portion and a second groove portion axially separated from the first groove portion by a tab, a trailing portion of the second groove portion having an axial length greater than a leading portion of the first groove portion, the leading portion extending from a first groove inner surface to the body inner surface, a leading angle being defined between a full length of the leading portion and the body inner surface being between 10° and 60°, the trailing portion of the second groove including a trailing surface at a downhole end of the receiving groove comprising an outer trailing surface extending at a first angle having an outer trailing surface height less than a tab height of the tab, the trailing surface further including an inner trailing surface extending axially at a second angle and between the outer trailing surface and the body inner surface, and the trailing portion extends toward the downhole end; and the tab defining an inner diameter which is greater than an inner diameter defined by the body inner surface directly uphole and downhole of the receiving groove.

8. The wellbore casing of claim 7, the tab having a tab leading surface at a non-zero angle relative to the body inner surface.

9. The wellbore casing of claim 7, the tab having at least a tab leading edge that is recessed a tab leading surface height from the body inner surface.

10. The wellbore casing of claim 7, the tab having a tab trailing surface having a non-zero angle relative to the body inner surface.

11. The wellbore casing of claim 7, the inner trailing surface with an inner trailing surface height that is equal to or less than a groove height of the receiving groove.

12. The wellbore casing of claim 11, the outer trailing surface extending at the first angle greater than 20° and the inner trailing surface extending at the second angle less than 20°.

13. The wellbore casing of claim 7, the tab having a tab leading surface or tab trailing surface at an angle of 2° to 15° relative to the body inner surface.

14. The wellbore casing of claim 7, the tab including one or more undercut portions.

15. A wellbore casing, comprising:

at least one casing segment cemented to a wellbore wall; and a downhole landing tool coupled to the at least one casing segment, the downhole landing tool comprising:

a body having a body inner surface defining an opening in the body;

a receiving groove located circumferentially on the body inner surface, the receiving groove including a first groove portion at an uphole end of the receiving groove and a second groove portion comprising a trailing surface at a downhole end of the receiving groove comprising an outer trailing surface extending at a first angle having an outer trailing surface height less than a tab height of a tab, the trailing surface further including an inner trailing surface extending axially at a second angle and between the outer trailing surface and the body inner surface; and the tab located within the receiving groove and axially separating the first groove portion and the second groove portion, the tab defining an inner diameter which is greater than an inner diameter defined by the body inner surface directly uphole and downhole of the receiving groove.

* * * * *